US005406287A

United States Patent [19]

Pinkus

[11] Patent Number: 5,406,287

[45] Date of Patent: Apr. 11, 1995

[54] PROGRAMMABLE AIRDROP INFRARED DECOY

[75] Inventor: Alan R. Pinkus, Dayton, Ohio

[73] Assignee: The United States of America as represented by the Secretary of the Air Force, Washington, D.C.

[21] Appl. No.: 168,501

[22] Filed: Dec. 22, 1993

[51] Int. Cl.[6] ..... G01J 1/00

[52] U.S. Cl. ..... 342/13; 250/495.1; 89/1.11

[58] Field of Search ..... 250/495.1, 494.1, 493.1; 342/12, 13; 102/504, 505, 354; 89/1.11

[56] References Cited

U.S. PATENT DOCUMENTS

| | | | |
|---|---|---|---|
| 3,320,420 | 5/1967 | Paglee et al. | 250/83.3 |
| 3,797,395 | 3/1974 | Tycoler | 102/354 |
| 3,902,172 | 8/1975 | Weiss et al. | 343/6 ND |
| 3,978,342 | 8/1976 | Hagen et al. | 250/495.1 |
| 4,478,581 | 10/1984 | Goda | 434/22 |
| 4,668,869 | 5/1987 | Matosian et al. | 250/493.1 |
| 4,700,190 | 10/1987 | Harrington | 342/2 |
| 4,705,477 | 11/1987 | Komorowski et al. | 434/24 |
| 5,238,406 | 8/1993 | Littell, III | 434/21 |
| 5,249,527 | 10/1993 | Schwind | 102/354 |
| 5,260,820 | 11/1993 | Bull et al. | 342/9 X |

*Primary Examiner*—Mark Hellner

*Attorney, Agent, or Firm*—Gerald B. Hollins; Thomas L. Kundert

[57] ABSTRACT

A battery powered self-contained source of infrared or other optical spectrum emission is disclosed. The emission source is provided with airdrop and other dispersal arrangements and is disposed in the form of an enclosed spherical or other housing which includes adjustment ports, adjusting tools, and tether cord attachment devices. The optical emission output of the disclosed source is adjustable as to flash duration and between-flash delay. In decoy device use the source is intended for multiple source deployments in a combat zone where the device output is collectively construable as a multiplicity of human originated emission events of random infrared energy pulses and is thereby capable of deceiving a night vision apparatus equipped enemy. Other uses of the invention including terrain marking and personnel location identification are also disclosed.

17 Claims, 2 Drawing Sheets

PROGRAMMABLE AIRDROP INFRARED DECOY

RIGHTS OF THE GOVERNMENT

The invention described herein may be manufactured and used by or for the Government of the United States for all governmental purposes without the payment of any royalty.

BACKGROUND OF THE INVENTION

This invention relates to the field of air deployable decoy devices and especially to the class of decoy devices usable against infrared responsive night vision equipment.

Military forces operating in a nighttime environment can emit infrared signatures that are detectable by enemy forces using night vision devices. These infrared signatures may originate in such apparatus as the flame from burning materials, even cigarette lighters, from flashlights, and of course from hot equipment such as vehicle engines and exhaust systems. A typical example of such emissions was illustrated in the recent desert storm military campaign wherein the United Nations forces were able to detect the sun heated barrels of enemy tank guns contrasted against the cooler nighttime desert sand with the use of infrared detection equipment.

With careful consideration such infrared signature emissions can be greatly decreased and even largely eliminated. Such reductions can be made even more effective with the use of stronger decoy signals originating in a close-by but unoccupied area where the receipt of enemy air action or artillery rounds is of little consequence and perhaps even helpful in enabling an understanding of enemy intentions and capabilities. The careful placement of a plurality of such infrared signal emitting decoy devices may be accomplished by both ground based and airborne dispersal techniques, e.g. a dispersal as simple as tossing such devices out of an open helicopter door. Such devices may be prearranged to emit a variety of infrared energy flash signals and also to have a variety of flash duration and inter-flash delay intervals so that the viewing of a group of these decoy devices from a distant ground or airborne perspective suggest the random activity of group of personnel.

Infrared signal emitting devices of this type may also be useful to provide terrain marking for such purposes as the interjection or extraction of military forces, and for target marking, especially with the use of smart monitors or heat seeking explosive devices. Although devices of this nature may be made responsive to any portion of the electromagnetic energy spectrum, including the radio frequency and visible light portions of the spectrum, practical considerations and the present day high development state of infrared equipment suggest that the infrared spectral region between 400 and 1100 nanometers of wavelength is of most interest for operating such decoy devices.

The patent art indicates the presence of inventive interest in the field of decoy devices and other apparatus relating as general background to the present invention. Several patents of this general background interest with respect to the present invention include U.S. Pat. No. 3,902,172 of Albert Weiss et al which is concerned with an infrared gated radio fuseing system wherein the detonation of amunitions device is accomplished through the use of both an infrared and a radio frequency signal. In the Weiss et al apparatus, the infrared signal is used to enable the radio frequency signal channel so that both proximity to the intended infrared energy emitting target and receipt of a radio frequency signal are required to accomplish the detonating event. Since the Weiss et al apparatus is concerned with munitions detonation, the present invention decoy apparatus is readily distinguished.

The patents of general background interest with respect to the present invention also include U.S. Pat. No. 4,705,477 which is issued to R. B. Komorowski et al and is concerned with a simulation of aerial decoy arrangements. In the Komorowski patent there is provided an apparatus for simulating a plurality of launcher barrels and the associated isolator module of an aerial infrared or chaff decoy arrangement. Since the Komorowski et al invention is concerned with decoy-rocket launching apparatus and its simulation, a ready distinction between the present invention and the Komorowski et al disclosure is apparent.

These patents of interest also include U.S. Pat. No. 4,478,581 issued to W. Goda et al and concerned with a score keeping and accuracy determining arrangement for gunnery practice. The Goda et al invention involves ballistic ammunition as opposed to remotely controlled ammunition. The Goda et al patent is also concerned with a moving target and with laser accomplished measurements relating to this target as a part of accuracy and score keeping operations. Since the Goda et al apparatus is concerned with gunnery practice and its scoring and not with the provision of decoy apparatus for misinforming an adversary, the present invention is readily distinguished.

These patents of general interest are also inclusive of the U.S. Pat. No. 3,320,420 issued to M. R. Paglee et al which is concerned with an infrared detection system for use in the early stages of a missile launch event. In these early stages, there are rapid angular position changes which, together with ground clutter, complicate the task of tracking the missile with radar. According to the Paglee et al apparatus a supplementary infrared detector is disengaged after some point in the missile's flight and reliance on the normal radar signal ensues. Since the Paglee et al apparatus is concerned with the tracking of an infrared emission source rather than the supplying of deceptive infrared signals, a ready distinction between the present invention and the Paglee et al apparatus is apparent.

The patent art of general interest with respect to the present invention also includes U.S. Pat. No. 4,700,190 issued to J. J. Harrington and concerned with a decoy device in the form of a missile. The Harrington patent is also concerned with enhancing the radar signal or radar cross-section of this decoy missile. This may be used in a multiple reentry vehicle missile system in order to deceive defending radar systems into a belief that each of the multiple reentry warheads is in fact a destructive vehicle rather than a decoy vehicle. Although the Harrington apparatus is concerned with decoy devices a distinction between the present invention night vision and ground deployed decoy devices and the missile decoy of the Harrington invention is readily discerned.

SUMMARY OF THE INVENTION

The present invention combines a programmable timer electronic circuit with infrared energy emitting source to form a self-contained air deployable decoy or marker device that is usable in conjunction with night vision equipment. The described apparatus includes a plurality of use commencing and terminating arrangements; it also enables a selection of operating cycles and is contemplated for use in large quantities over an aircraft-surveyed area.

It is an object of the present invention therefore to provide an infrared signal emitting decoy device which may be deployed from aircraft or ground based deployment systems.

It is another object of the invention to provide an infrared signal emitting decoy which operates from a self contained electrical energy source such as a battery, and employs energy emitting devices such as light emitting diodes.

It is another object of the invention to provide an infrared signal emitting decoy device which may be preprogrammed to emit a variety of differing flash signal characteristics.

It is another object of the invention to provide an infrared signal emitting decoy device that is of small and rugged construction, such as may be successfully used in extreme conditions of environment.

It is another object of the invention to provide an infrared signal emitting decoy device which may be deployed in a variety of physical orientations while yet providing a useful and functional output signal.

It is another object of the invention to provide an infrared energy decoy apparatus having operational initiation and termination that may be accomplished in a plurality of militarily advantageous manners.

Additional objects and features of the invention will be understood from the following description and claims and the accompanying drawings.

These and other objects of the invention are achieved by airdrop deployable optical spectrum radiant energy source apparatus comprising the combination of:

- an enclosed hand engageable symmetrically shaped container member of impact resistant organic material composition;
- a plurality of optical spectrum external radiant energy emitting electrical energy to optical energy transducer elements disposed about an external peripheral surface of said container member;
- programmable electronic timing means received within said container member and connected at an output signal port thereof with said electrical energy to optical energy transducer elements for controlling the energized and non energized operating cycle thereof;
- electrical energy source means received within said container member and connected with said electronic timing means and said transducer elements for energizing said elements and;
- electrical switch means received in said container member in electrical connection with said electrical energy source means and responsive to predetermined selected external and internal stimuli for initiating and terminating energization of said electronic timing means and said transducer elements from said electrical energy source means.

DETAILED DESCRIPTION

Figure 1:
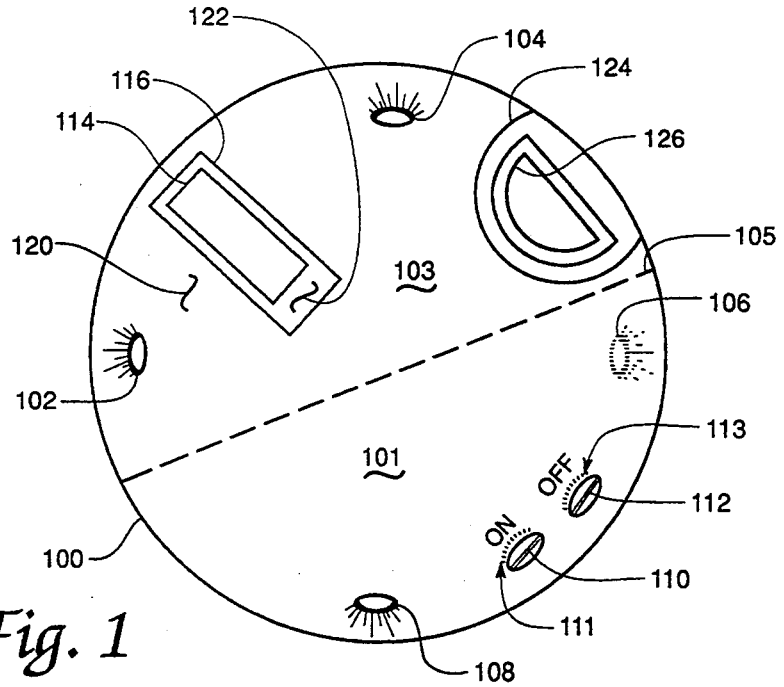
FIG. 1 is an external perspective view of a decoy apparatus according to the present invention.

FIG. 1 in the drawings shows an overall perspective view of a programmable airdrop infrared decoy apparatus in accordance with the present invention. In the FIG. 1 drawing the decoy device 100 is shown to include a spherically shaped closed housing member 120 which may be fabricated from impact resistant plastics such as Delrin TM.

The housing member 120 may be disposed in the form of two mating hemispherical halves 101 and 103 which are held together with mechanical fastener apparatus or chemical bonding agents (at a junction 105) as are also known in the plastic article assembly art.

Disposed about the periphery of the housing member 120 are a plurality of infrared energy emitting transducer elements, such as light emitting diodes, as are indicated at 102, 104, 106, and 108 in FIG. 1. These infrared energy emitting elements are preferably disposed about the peripheral surface of the housing member 120 in such a manner that any physical orientation or positioning of the housing member 120 on its curved exterior surface will result in at least one of these infrared energy emitting elements being visible from any position above the decoy device. One arrangement for accomplishing this disposition is to locate the infrared emitting elements at the four intercept points of an inscribed tetrahedron with the surface of the housing member 120.

In some uses of the FIG. 1 apparatus, it may be desirable to provide for a larger number of the energy emitting elements 102–108 in order to assure visibility from more possible locations above and around the housing number 120. The infrared energy emitting elements 102–108 may be selected in size and physical configuration from a variety of such devices, including laser devices, that are known in the electronics art. These infrared energy emitting elements are preferably provided with such lenses and hermetic seals as is necessary to suitably disperse their energy emissions and maintain the outdoor environment and battlefield integrity of the decoy device under hostile conditions.

Additionally shown in the FIG. 1 view are the adjustment controls 110 and 112 by which the ON time and OFF time components of the decoy device operating cycle may be selected in advance of device dispersal. Adjustment scales, which may be logarithmic in nature, for these two adjustments are indicated at 111 and 113, respectively, in FIG. 1. The adjustment controls 110 and 112 may be in the form of screwdriver slot engageable potentiometers or detented switch devices. These adjustment controls are also preferably arranged to include both repeatable time periods of operator selected duration and also variable time settings wherein at least a pseudo random cycle of infrared device emissions is achieved.

Figure 3:
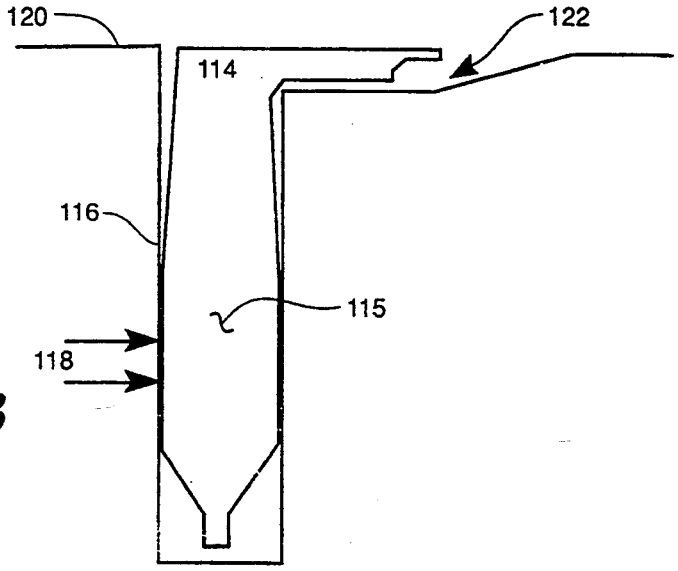
FIG. 3 shows details of an adjustment tool and its reception cavity in the FIG. 1 apparatus.

A tool for manipulating the adjustment controls 110 and 112 may also be provided in the FIG. 1 decoy device. Such a tool is represented by the screwdriver handle portion indicated at 114 in FIG. 1. The screwdriver of this handle portion 114 is shown in FIG. 1 to be received in a receptacle cavity 116 which extends inward toward the center of the circle housing member 120 in a manner which is best understood from a viewing of FIG. 3. A finger or tool entry space to enable removal of the screwdriver handle portion 114 appears at 122 in the FIG. 1, FIG. 3 and FIG. 4 drawings.

Figure 4:
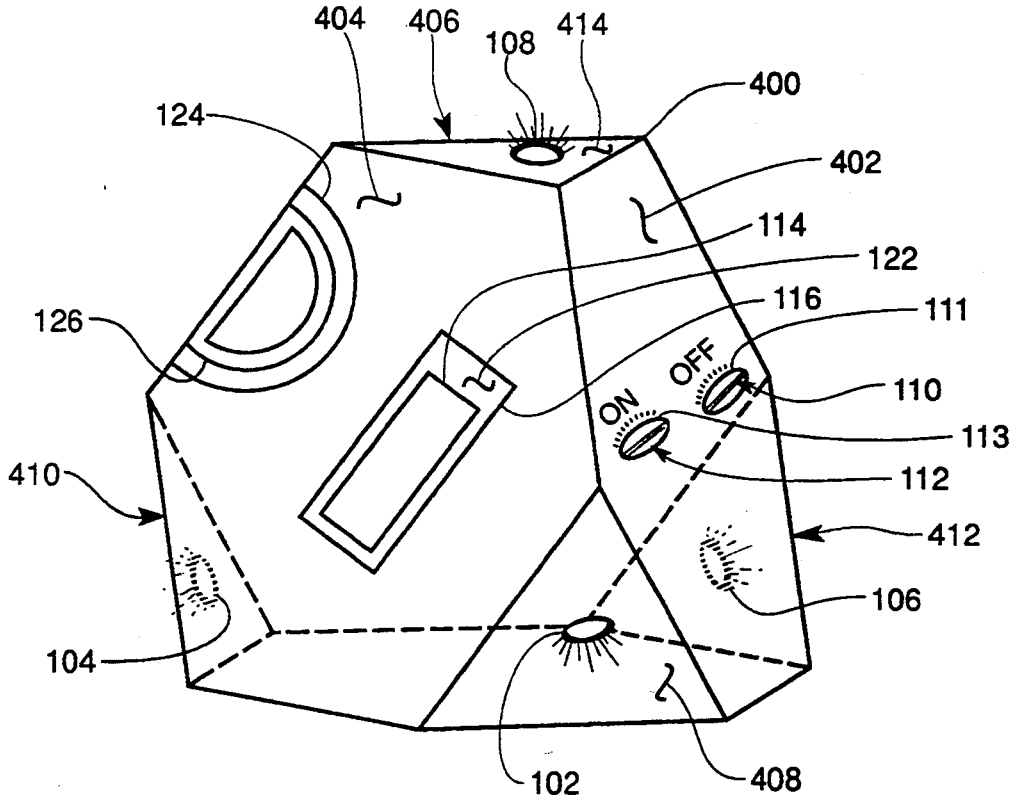
FIG. 4 shows a truncated pyramid preferred enclosure arrangement of the invention.

At 124 and 126 respectively on the surface of the FIG. 1 and FIG. 4 decoy devices are shown a recessed area and anchor ring such as may be used to allow a tether connection to the housing member 120. Such tether connection in the form of a lanyard or cord device may be useful in both the dispersal and in any subsequent retrieval of the FIG. 1 or FIG. 4 devices from a battle area. Such a tether arrangement may also be useful in fixing the position or location of the FIG. 1 and FIG. 4 device with respect to a tree, a bush or other terrain feature.

Figure 2:
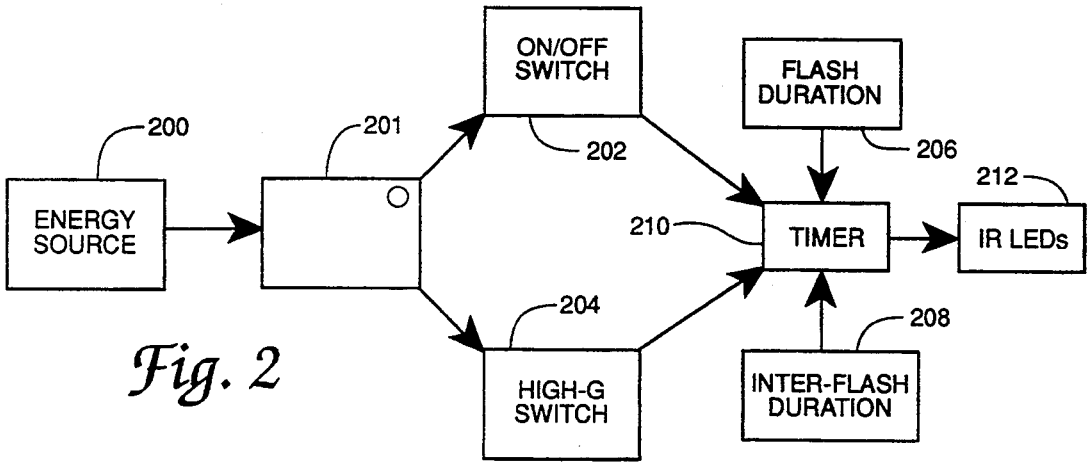
FIG. 2 is a functional block diagram of electrical circuitry for the FIG. 1 decoy device.

FIG. 2 in the drawings shows a block diagram of the energizing and operating electrical circuitry which may be received within the housing 120 of the FIG. 1 decoy device. In the FIG. 2 circuit the light emitting diodes 102–108 of FIG. 1 and FIG. 4 are represented at 212 and a source of electrical energy, preferably a lithium or other long life battery, is indicated at 200. The flow of energy from the source 200 to the infrared emitting transducer elements at 212 is shown to be controlled by both a plurality of on/off switching elements which are indicated at 201,202, and 204 in FIG. 2 and also by the timing circuit indicated at 210.

The master turn OFF switch indicated at 201 in FIG. 2 provides for interruption of energy flow between the source 200 and the light emitting diodes at 212 in response to some predetermined event such as the occurrence of sunrise or an attempt by enemy personnel to make use of the decoyed device. The master turn OFF switch 201 may be inclusive of a photo detector element in the former case and responsive to a physical disturbance of the decoy device or the elapsing of a predetermined operating time in the latter enemy use denial situation. This enemy use denial feature may also be usefully combined with the above described chemical reaction based assembly of the housing member 120 for its components 101 and 103; such an assembly being arranged in a manner precluding disassembly of the housing member 120 without incurring both its permanent turn-off and physical destruction in order to more fully preclude enemy use of the decoy device.

The decoy device 100 may also be provided with a normal manual ON-OFF switch indicated at 202 to enable control of the emitted infrared energy by human intervention. The FIG. 1 and FIG. 4 apparatus in addition may be provided with a "G" force responsive switch 204 to provide turn ON in response to the landing impact of an airborne dispersal event. In particular embodiments of the invention, one or more of the switches 201, 202, and 204 may of course be omitted to reduce cost or accommodate the requirements of a particular application of the invention.

In addition to or in lieu of the switches 202 and 204 the decoy device 100 may also be provided with a radio frequency receiver and turn ON switch in order that a plurality of decoy devices 100, as may be dispersed over a combat zone, may be activated or deactivated in response to a command originating with personnel located some distance away from the decoy area. Such a radio frequency receiver is preferably arranged as a receiver tuned to a higher operating frequency such as the UHF band of frequencies in order that its antenna requirements be small in physical size and both antenna and receiver be disposable within the housing members 120 or 400. Since the housing member 120 is preferably in the order of four inches of outside diameter, it is clear that some restriction of self-contained antenna dimensions is necessary.

A timer circuit for controlling the duration time of each flash event for the LED devices 102–108 and also for determining the time interval between flashes is indicated at 210 in FIG. 2. The circuit 210 is preferably embodied in the form of an electronic circuit of the adjustable time determining type or alternately as a programmed digital computer wherein program flow changes can be accomplished with selections made via the controls 110 and 112 in FIG. 1 and FIG. 4. In this latter digital computer arrangement of the timing circuit 210 it is also possible to include pseudo random time generation algorithms in order to provide infrared energy decoy signals that avoid the element of predictable repetition. Scale graduations for the controls 110 and 112 are indicated at 111 and 113 in the FIG. 1 drawing. The timer circuit 210 is also provided with power transistor driver circuitry capable of electrically switching the current flow of the infrared LED devices indicated at 212.

Returning again to the elements 114 and 116 in FIG. 1 and FIG. 4, these identifications relate respectively to the handle and storage receptacle for an adjustment tool or screwdriver device that may be used in combat environments for manipulation of the controls 110 and 112. Additional details of this arrangement are shown in the enlarged sectional view of FIG. 3 where the screwdriver device body portion is indicated at 115, the handle portion at 114 and the receptacle cavity at 116. The nature of the removal finger clearance space at 122 is also apparent in the FIG. 3 view. The screwdriver 115 is retained in the cavity 116 by a frictional fit engagement in the region 118.

The FIG. 1 decoy device 100 is shown to include a spherically shaped outer housing; however, for some use purposes a flat sided housing configuration may be preferable. A twelve sided or dodecahedron shaped housing may, for example be substituted for the indicated spherical shape where flat sides are desired for stable positioning or other purposes.

FIG. 4 in the drawings shows an eight sided truncated pyramid enclosure arrangement of the invention, an arrangement which is in fact preferred in view of its ease of fabrication, its self-righting tendency and other advantages. The FIG. 4 view of the truncated pyramid enclosure embodiment of the invention is perspective in nature and is in fact a right frontal view taken from a ten degree elevation viewpoint. The drawing of FIG. 4 also shows the array of hidden or invisible lines residing on the backside of the pyramid structure A shape of the FIG. 4 type has been found to be desirable in airdrop and self righting object situations; most notably such a shape is understood to be receiving serious consideration for use in the forthcoming Martin Lander program of the National Aeronautics and Space Administration. The FIG. 4 enclosure 400 is actually comprised of a three-sided pyramid that is modified by a removal or truncation of each of the vertices of the pyramid. In FIG. 4 the three pyramid sides appear at 402,404, and 406 and the four truncated vertices surfaces appear at 408, 410, 412, and 414. Clearly the concepts of the FIG. 4 embodiment of the invention are not limited to the illustrated three lateral sided shape, but may include other pyramidal configurations and related geometric shapes.

In the FIG. 4 preferred arrangement of the invention, the infrared energy emitting elements 102–108 are preferably located in the four truncated vertices surfaces 408, 410, 412 and 414 respectively and are in fact recessed or in counter-sink relationship with these surfaces as shown for the element 102. This arrangement minimizes damage from landing impact or other physical events.

The FIG. 4 truncated pyramid preferred arrangement of the invention is also provided with the recessed area 124 and anchor ring 126 that are discussed above in connection with the FIG. 1 embodiment of the invention. The handle portion of the adjustment screwdriver and its receptacle cavity 116 and finger or tool entry space 122 as discussed in the FIG. 1 embodiment of the invention are also received in the FIG. 4 enclosure 400. In a similar manner the adjustment controls 110 and 112 and their graduated scales 111 and 113 as described in connection with FIG. 1 are also shown in the FIG. 4 enclosure.

The truncated pyramid shape as shown in FIG. 4 is also desirable from a small quantity prototype fabrication of the invention viewpoint since the machining of flat surfaces for the enclosure (or for its fabrication dies) is more easily accomplished than are the curved surfaces of the FIG. 1 embodiment of the invention. The FIG. 4 enclosure shape also provides the advantage of having significant self righting tendencies, particularly in the case of a landing on the truncated vertices surfaces 408, 410, 412 and 414. The FIG. 4 truncated pyramid shape also offers the advantage of being efficient in its use of storage space. Accessing of the internal components of the decoy device may be achieved by providing the enclosure 400 with a removable side. The adversary use denial feature may be included in this removable side capability with the use of sealants and/or pyrotechnic devices as are known in the military apparatus art.

It should also be recognized that a device of the FIG. 1 or FIG. 4 type may be useful in military operations for the purpose of marking a particular geographic region for some subsequent military purpose such as use as a landing zone or as a personnel pick-up area or even for the purpose of receiving artillery or smart munitions bombardment. In this latter instance, the transmission spectrum of the infrared devices 102–108 and the optical bandpass characteristics of the smart munitions guidance system are made spectrally compatible. Another alternative arrangement of the invention includes the use of a time delayed activation following the occurrence of a turn-ON or turn-OFF event of the type described in connection with the blocks 202 and 204 in FIG. 2. Such a turn-ON delay is achievable with an additional timer circuit that is activated by the described switching devices.

The described apparatus therefore provides a small low cost combat environment hardened source of optical spectrum energy, such as infrared energy that may be used for decoy or marker or other military purposes. The described apparatus includes flexibility and alternate arrangements and combat zone selection of characteristics and is capable of airborne or other deployment arrangements.

While the apparatus and method herein described constitute a preferred embodiment of the invention, it is to be understood that the invention is not limited to this precise form of apparatus or method and that changes may be made therein without departing from the scope of the invention which is defined in the appended claims.

I claim:

1. Airdrop deployable optical spectrum radiant energy source apparatus comprising the combination of:

an enclosed hand engagement shaped container member of impact resistant organic material composition;

a plurality of optical spectrum external radiant energy emitting electrical energy to optical energy transducer elements disposed about an external peripheral surface of said container member;

programmable electronic timing means received within said container member and connected at an output signal port thereof with said electrical energy to optical energy transducer elements for controlling the energized and non energized operating cycle thereof;

electrical energy source means received within said container member and connected with said electronic timing means and said transducer elements for energizing said elements and;

electrical switch means received in said container member in electrical connection with said electrical energy source means and responsive to predetermined selected external and internal stimuli for initiating and terminating energization of said electronic timing means and said transducer elements from said electrical energy source means.

2. The apparatus of claim 1 wherein said radiant energy to optical energy transducer elements are infrared spectrum light emitting diodes operating in the wavelength range of 400 to 1100 nanometers and are at least three in number.

3. The apparatus of claim 1 wherein said energized and non energized operating cycle comprises pseudo random intervals of energization event time duration and energization event segregating time delays.

4. The apparatus of claim 1 wherein said electrical switch predetermined selected initiating external and internal stimuli include one of;

a deployment impact responsive switching event and a manually accomplished predeployment switching event.

5. The apparatus of claim 1 wherein said electrical switch predetermined selected initiating external and internal stimuli include a response from an ambient light responsive photosensor.

6. The apparatus of claim 1 wherein said shaped container member is comprised of one of the enclosure configurations of a truncated pyramid and an spherical enclosure.

7. The method for deceiving a night vision equipped military adversary comprising the steps of:

deploying a plurality of portable self enclosed infrared energy emitting optical energy sources over an area of surveillance by said adversary;

energizing each of said optical energy sources in a predetermined cycle of ON and OFF operation from a self contained source of electrical energy and;

terminating said energizing of said optical energy sources in response to a predetermined adversary usage denying termination criteria.

8. The method of claim 7 wherein said adversary resides in one of the positions of an overlooking geographic terrain feature and presence within an overlying aircraft and further including the step of disposing said optical energy sources for viewing from said positions.

9. The method of claim 7 wherein said deploying step comprises dispersing said optical energy sources from an aircraft.

10. The method of claim 7 wherein said predetermined cycle of ON and OFF operation comprises an asynchronous sequence of pseudo random duration and spacing interval energizing of said optical energy sources and thereby resembles the use of cigarette lighters, flashlights and other sources of infrared energy by a plurality of persons.

11. The method of claim 7 wherein said terminating step predetermined adversary usage denying termination criteria comprise one of the criteria of operating time duration, ambient light response, a predetermined signal received from an external signal source, and a physical disturbance of a portable optical energy source.

12. The method of claim 9 wherein said energizing step includes energization enablement in response to an aircraft dispersion-related landing impact event.

13. The method of claim 7 further including the step of conditioning the guidance system of a smart munitions explosive device to home-in on said emitted infrared energy emissions.

14. Night vision deception apparatus comprising the combination of:

a plurality of air deployable infrared energy emitting decoy devices;

means received within each of said decoy devices for controlling an operating cycle thereof according to predetermined ON and OFF sequence in response to a predetermined event;

an electrical battery energization source received in each said decoy device.

15. Night vision deception apparatus comprising the combination of:

a plurality of air deployable infrared energy emitting decoy devices;

means received within each of said decoy devices for controlling an operating cycle thereof according to a predetermined ON and OFF sequence in response to a predetermined event;

ground impact event responsive means for controlling energization of each of said decoy devices.

16. Night vision deception apparatus comprising the combination of:

a plurality of air deployable infrared energy emitting decoy devices;

means received within each of said decoy devices for controlling an operating cycle thereof according to a predetermined ON and OFF sequence in response to a predetermined event;

said predetermined sequence of ON and OFF events being asymmetric and inclusive of random timing durations.

17. Night vision deception apparatus comprising the combination of:

a plurality of air deployable infrared energy emitting decoy devices;

means received within each of said decoy devices for controlling an operating cycle thereof according to a predetermined ON and OFF sequence in response to a predetermined event;

each of said decoy devices further including an impact resistant external housing member having one of eight and twelve flattened surfaces disposed therein.

* * * * *

UNITED STATES PATENT AND TRADEMARK OFFICE

CERTIFICATE OF CORRECTION

PATENT NO. : 5,406,287

DATED : Apr. 11, 1995

INVENTOR(S) : Alan R. Pinkus

It is certified that error appears in the above-indentified patent and that said Letters Patent is hereby corrected as shown below:

Column 1, line 45, "suggest" should be ---suggests---.

Column 1, line 66, "amunitions" should be ---a munitions---.

Column 3, line 29, ---arrangements--- should follow "termination".

Column 9, line 33, the following missing paragraph should be inserted:
---a plurality of light emitting diodes spaced about an external surface of each of said decoy devices; and---.

Signed and Sealed this

Twenty-third Day of January, 1996

*Attest:*

Bruce Lehman

BRUCE LEHMAN

*Attesting Officer*

*Commissioner of Patents and Trademarks*